United States Patent [19]

Hoshi et al.

[11] 3,972,127

[45] Aug. 3, 1976

[54] PROCESS AND APPARATUS FOR HEAT TREATMENT OF SYNTHETIC FIBER ASSEMBLIES

[75] Inventors: Toyohiko Hoshi; Masayoshi Shimojo; Yasunori Suma, all of Fuji, Japan

[73] Assignee: Asahi Kasei Kogyo Kabushiki Kaisha, Osaka, Japan

[22] Filed: Sept. 12, 1974

[21] Appl. No.: 505,443

[30] Foreign Application Priority Data

Sept. 14, 1973 Japan ..... 48-104208

[52] U.S. Cl. ..... 34/4; 34/18; 34/41; 34/66; 34/242; 219/343; 219/411

[51] Int. Cl.[2] ..... F26B 3/30

[58] Field of Search ..... 34/1, 4, 41, 242, 18, 34/62, 66; 219/343, 400, 405, 411; 432/8, 59, 26, 249; 239/592–594, 53.3, 590.3, 597

[56] References Cited

UNITED STATES PATENTS

| | | | |
|---|---|---|---|
| 1,560,589 | 11/1925 | Andrews et al. | 34/18 |
| 2,360,257 | 10/1944 | Muller et al. | 34/233 |
| 2,379,653 | 7/1945 | Ridley | 34/4 |
| 2,629,162 | 2/1953 | Peck | 34/41 |
| 3,222,895 | 12/1965 | Sheppard | 34/62 |
| 3,398,466 | 8/1968 | Brown | 239/553.3 |
| 3,409,460 | 11/1968 | Mitchell et al. | 34/4 |
| 3,448,526 | 6/1969 | Smith, Jr. | 34/4 |
| 3,639,207 | 2/1972 | Genz et al. | 34/18 |
| 3,659,551 | 5/1972 | McKinstry | 34/242 |

*Primary Examiner*—John J. Camby
*Assistant Examiner*—Larry I. Schwartz
*Attorney, Agent, or Firm*—Burgess, Dinklage & Sprung

[57] ABSTRACT

Process and apparatus by means of which synthetic fiber tow, sliver or yarn is heated in a relaxed state or under tension. The material, while passing through a horizontally elongated oven provided with a series of infrared ray heaters on both the top and bottom walls, is irradiated by far infrared rays having a peak wave length of 3.5 to 7.0 $\mu$, while an air curtain is formed between the material and each series of infrared ray heaters; the atmosphere surrounding the material in the oven is kept at 80° to 280°C. Rapid treatment is possible without any adverse effects on the material.

11 Claims, 14 Drawing Figures

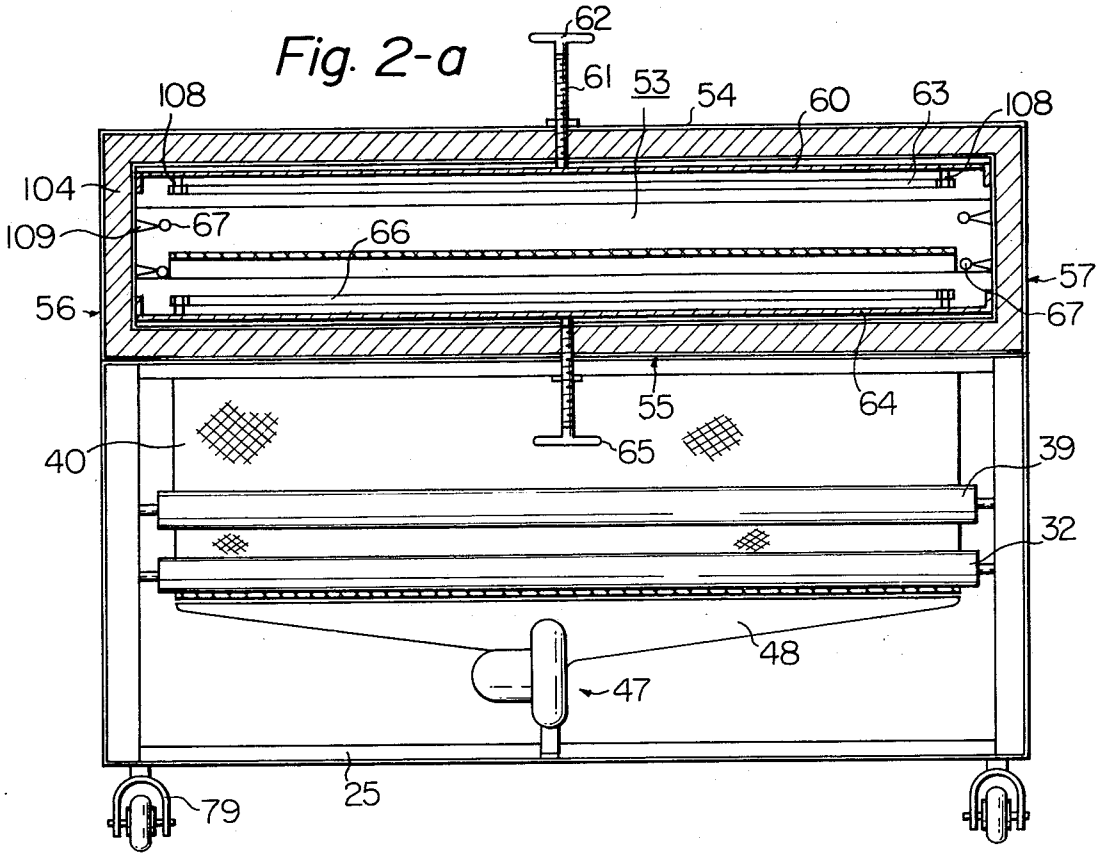
Fig. 2-a

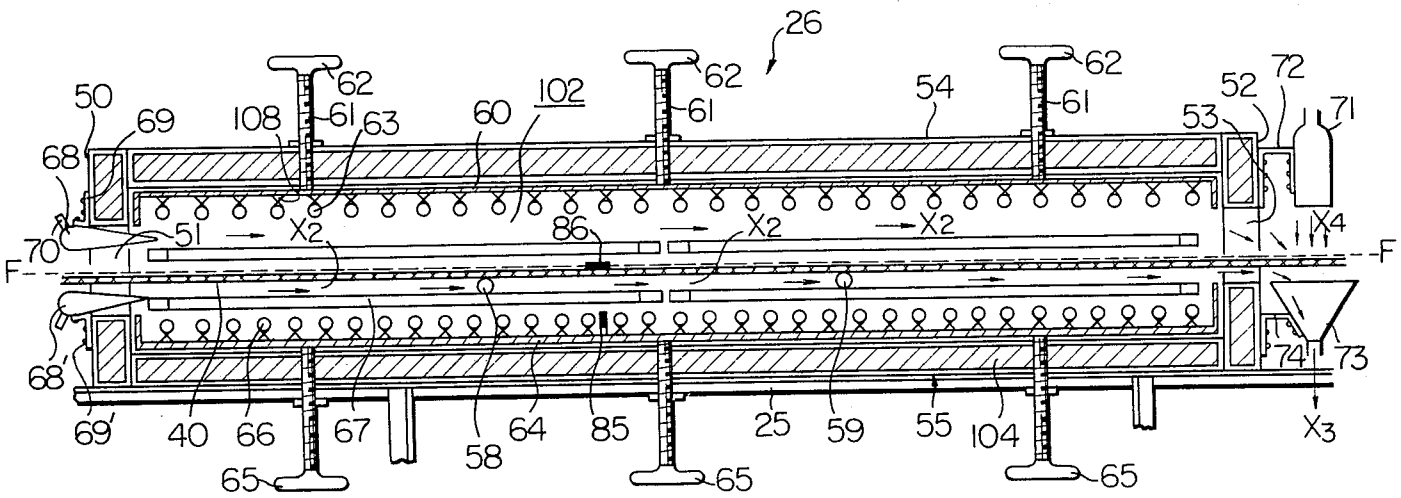
Fig. 2-b

TEMPERATURE IN THE OVEN
(°C)
400
300
200
100
0
INLET
DISTANCE FROM THE INLET OF THE OVEN
OUTLET
e
g
f

PROCESS AND APPARATUS FOR HEAT TREATMENT OF SYNTHETIC FIBER ASSEMBLIES

FIELD OF THE INVENTION

The present invention relates to a process for continuous heat treatment of fiber assemblies using far infrared rays and an apparatus adapted to realize the process.

It should be noted that the term "fiber assemblies" as used herein means any assembly of fibers such as a continuous tow or staple obtained in a process of manufacturing synthetic fibers, a fleece or sliver obtained in a prespinning process or a spun yarn. Furthermore, the term "synthetic fiber" as used herein includes fibers of synthetic polymers, such as polyamides, polyesters, polyacrylonitriles, polyvinyl alcohols, polyvinylidene chlorides, polyvinvyl chlorides, polyethylenes, polypropylenes, polyurethanes, polystyrenes, and polyestereth-ers. The term "heat treatment" as used herein means all usually employed types of treatment using a heat medium such as steam or hot air, inclusive of thermal drying, thermal drawing, thermal relaxation, thermal fixation and so on conventionally utilized in the field of fiber industry.

DESCRIPTION OF THE PRIOR ART

Heat media such as hot water, heated air and steam have conventionally been used as the energy sources for heat treatment in the manufacturing process of synthetic fibers and in the subsequent processes such as spinning and dyeing. The lattice dryer, for example, has usually been used for drying purposes in the manufacturing process of acrylic fibers, wherein the tow to be treated is introduced onto the lattice and subjected to hot air which is circulated by a circulation fan and driven from above against the tow so that the heat convection brings the tow to a dried condition. In using air as the heat medium, however, there are various problems. One of these problems is the yellowing of fiber which often occurs when the air temperature is raised to improve the drying efficiency. Another problem is the disturbance of travelling fibers which may take place when the amount or the velocity of hot air provided by the circulation fan is intentionally increased. Still another problem encountered in use of the device of such type is that the heat treatment is necessary for a period as long as almost one hour because the factors to be utilized for fast drying purposes are strictly limited and this aspect is disadvantageous for high-speed and high-productivity manufacturing. A still further problem is due to phenomena that, especially in case of high moisture content tow, the lattice dryer delivers a tow which is too moist because of insufficient drying, which tow often becomes milky. Thermal relaxation is used, for example, in manufacturing acrylic bulky spun yarns. A tow of acrylic fibers is subjected to thermal drawing and then stretch-broken by a converter, such as a turbo-stapler, so that the tow is converted into slivers, which are shrinkable. A portion of the shrinkable slivers is thermally relaxed to provide non-shrinkable slivers. The non-shrinkable slivers are mixed spun with the other portions of the shrinkable slivers into a mixed spun yarn. In the thermal relaxation step of the above described process, the slivers are accommodated into perforated aluminum cans which are then placed in a steam setter and subjected to heat treatment under vacuum. Since such a step is batchwise, instead of being continuous, and requires a period of treatment for 30 minutes or longer, it is impossible to operate a whole process continuously and, thus, this step constitutes a bottleneck in the elimination or reduction of labor. Moreover, maintenance of the steam setter requires a supply of water for the condenser and supply of turbine oil for the vacuum pump with the result that prodigious labor is necessary. Furthermore, the labor environment is extremely severe since operation of the can exchange must be done in an atmosphere of high temperature due to the steam. As for the product quality, there often occurs unevenness of setting especially when the density with which a sliver is charged into a can is high, since it is difficult for steam to reach the interior thereof. Furthermore, as a sliver shrinks the fibers are often bonded with adjacent fibers under the adhesive effect of moisture, thus resulting in a shrunken sliver with a hard and coarse feel. In such shrunken slivers, the fibers are difficult to separate from each other. This results in various inconveniences at the subsequent spinning process such as increase of drafting force and formation of slub and nep yarns.

As a countermeasure against the process mentioned just above, there has been suggested a process in which the slivers are subjected to thermal relaxation by dried and heated air. However, this process has not been used in practice since the period of treatment must be extremely long and there often takes place not only unevenness of setting but also yellowing of slivers.

In the manufacture of bulky spun yarns, hanks of spun yarns have heretofore been heat treated with steam in the step of thermal relaxation for developing bulkiness. Such a process is, however, a batchwise steam setting process which requires prodigious labor as well as prolonged heat treatment and often results in yarns of too high a moisture content so that a further drying treatment may be necessary. Furthermore, steam cannot reach the portion of the bar which supports the hanks, and that portion of the hanks directly in contact with the bar consequently becomes a yarn of poor bulkiness.

It will be understood from the foregoing discussion that the conventional heat treatment of synthetic fibers is unsatisfactory in various aspects such as economy, efficiency and product quality.

To overcome the above-discussed drawbacks of the prior-art there has already been proposed a process and an apparatus in which the fiber assembly is exposed to infrared radiation and thereby heat treatment is carried out in a continuous manner (see the Dutch Pat. No. 7108728).

The Dutch Pat. No. 7108728 relates to a process and an apparatus for thermal fixation of a tow of synthetic fibers or the like. The process disclosed by the above identified patent is such that tows aligned in sheet form are heated by infrared radiation while being fed under tension. The apparatus to realize this process comprises an oven including infrared ray generating lamps disposed on an upper inner wall of the oven and a reflecting plate disposed on the opposite inner wall, wherein the tows are continuously fed under tension between said infrared ray generating lamps and said reflecting plate to achieve heat treatment. Although this process and apparatus are advantageous in that the period of heat treatment may be shortened since infrared radiation is utilized, there remains various disadvantages as follows. First, the upper surfaces of tows are directly heated by infrared radiation from generating lamps while the lower surfaces of tows are heated by infrared radiation reflected by the reflecting plate and therefore, the tows may be unevenly heated; second, since suction devices are used to circulate the air within the oven in such a manner that the direction of air flow is transverse to that of tows being fed, this apparatus may disturb the tows and, therefore, this apparatus cannot be used for heat treatment other than thermal fixation; third, the infrared ray generating lamps themselves are at high temperature since the infrared ray has a peak wave length as short as 3.2 $\mu$ and the temperature within the oven is readily raised by thermal conduction and convection based on said high temperature of the lamps with a result that the tows are likely to undergo heat deterioration and yellowing and fourth, insufficient heat treatment effect results in the requirement for further heat treatment processes before or/and after this process.

We have previously proposed an improved process as disclosed in Japanese Laying-open Publication Ser. No. 48-93,748, wherein direct convection and conduction of heat from infrared ray heaters to the material to be treated are prevented by suitable solid filters placed between the heaters and the material. This process may effectively prevent the temperature within the device for heat treatment from being excessively raised, so far as the filters are properly cooled, and thereby yellowing of the fiber assembly may be avoided. This process is still disadvantageous, however, in that suitable filter material such as KRS No. 5 (comprising a mixture of thallium bromide and thallium iodide) is expensive and difficult to be shaped into sheets of considerable dimensions and in that proper cooling of such filters in the oven is not easy.

SUMMARY OF THE INVENTION

An object of the present invention is to provide a new process and apparatus for heat treatment of synthetic fiber assemblies, using far infrared radiation of far infrared ray.

Another object of the present invention is to provide a process and an apparatus for heat treatment of synthetic fiber assemblies which can continuously treat synthetic fiber assemblies within a short period without causing the product to become hard and coarse or to yellow.

Still another object of the invention is to provide a process and an apparatus which can be used for various type heat treatments of synthetic fiber assemblies, including thermal fixation, thermal relaxation, thermal drawing and thermal drying.

A further object of the invention is to provide a process and an apparatus for heat treatment of various type synthetic fiber assemblies, for example tows, staples, fleeces, slivers and spun yarns.

A still further object of the invention is to provide such a process and an apparatus for heat treatment of fiber assemblies by which even and uniform treatment may readily be accomplished.

Still another object of the invention is to provide such a process and an apparatus for heat treatment of fiber assemblies which require neither pre-heating nor post-heating steps.

Other objects and advantages will be apparent from the following description together with the appended claims and the accompanying drawings.

According to one aspect of the invention we provide a process for heat treatment of synthetic fiber assemblies, which comprises the steps of: continuously feeding a synthetic fiber assembly to one end of a horizontally elongated treating zone provided with series of far infrared ray radiation sources at the top and bottom thereof; continuously advancing said fiber assembly through said zone; irradiating said fiber assembly with far infrared rays from said series of sources, having such an energy distribution that the peak wave length is within the range between 3.5 $\mu$ and 7.0 $\mu$; forming an air curtain between said fiber assembly and each of said series of far infrared ray radiation sources by ejecting compressed air from said end of said zone into said zone, each of said air curtains being spaced from said fiber assembly and extending in parallel to said fiber assembly over substantially the whole width and length of said zone; keeping an atomosphere between said air curtains in said zone which directly contacts said fiber assembly at a substantially constant temperature within the range between 80°C and 280°C; and continuously withdrawing said fiber assembly from the other end of said elongated treating zone.

According to another aspect of the invention we provide an apparatus for heat treatment of synthetic fiber assemblies, which comprises: a horizontally elongated oven having an inlet at one end and an outlet at the other end; means by which a synthetic fiber assembly is fed to, advanced through and withdrawn from said oven; two series of infrared ray heaters arranged inside said oven on the top and bottom walls thereof and; a pair of means provided adjacent to said inlet for ejecting compressed air into said oven to form a pair of air curtains between said fiber assembly and respective said series of heaters, each of said air curtains being spaced from said fiber assembly and extending in parallel to said fiber assembly over substantially the whole width and length of said oven.

One of the most important features of the invention is the formation of an air curtain between the fiber assembly to be heat treated and each series of far infrared ray heaters, by ejecting compressed air into the oven in a direction which is the same as the advancing direction of the fiber assembly, which air curtain is spaced from the fiber assembly and extends in parallel to the fiber assembly over substantially the whole width and length of the oven. Such air curtains effectively protect the fiber assembly running through the oven from hot atmospheres adjacent to the infrared ray heaters, whereby undesirable yellowing of fiber may be avoided.

An atmosphere between the air curtains which directly contacts the fiber assembly is maintained at a substantially suitable temperature within the range from 80°C to 280°C which does not cause any undesirable discoloration and deterioration of fiber. Thus, in accordance with the invention the fiber assembly to be heat treated receives heat from the infrared ray heaters by radiation as well as from the surrounding atmosphere, which is kept at a temperature of 80°C to 280°C, by conduction. We have found that this combined heating system ensures a reasonably rapid treatment without suffering from yellowing of fiber and other disadvantages. Furthermore, since the air curtains are formed in parallel to and spaced from the fiber assembly, the air streams forming the air curtains do not disturb the fiber assembly. Accordingly, the process and apparatus of the invention are applicable to not only fiber assemblies under tension but also relaxed fiber assemblies.

BRIEF DESCRIPTION OF THE DRAWINGS

The following description gives a detailed explanation of the invention with reference to the accompanying drawings in which:

FIG. 2-*a* is an enlarged transverse cross-sectional view taken in a plane indicated by II — II in FIG. 1;

FIG. 2-*b* is an enlarged longitudinal cross sectional view of one part of FIG. 1;

DESCRIPTION OF THE PREFERRED EMBODIMENTS

Figure 1:
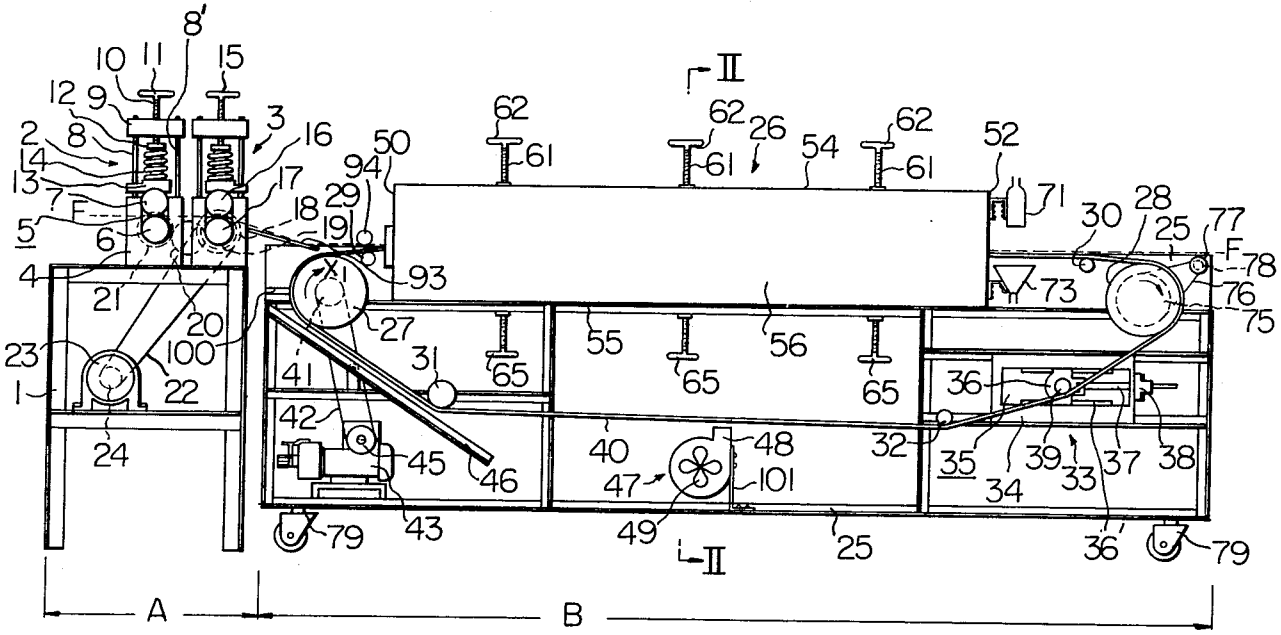
FIG. 1 is a longitudinal side view of an embodiment of an apparatus according to the invention.

Refering to FIG. 1, 2-*a* and 2-*b*, there is shown an embodiment of an apparatus for heat treatment of synthetic fiber assemblies according to the invention. The illustrated apparatus may be used for thermal drying and thermal relaxation of synthetic fiber assemblies. The apparatus has a feeding station A and a heat treating station B. The feeding station A has a frame 1 constructed by welding angle members, on which there is provided feed roller devices 2 and 3. The feed roller device 2 has two bearing plates 4 (only one of which is shown in FIG. 1), which are secured to the upper surface of the frame 1 at both sides thereof. Each bearing plate 4 has a U-shaped aligned slot 5. Transversely elongated roller 6 is carried on the bottom surface of the slots 5. Transversely elongated roller 7 which rotates freely is rested on the roller 6.

Two rods 8 and 8' which are parallel to each other are secured to the upper end of each bearing plate 4.

The upper ends of the rods 8 and 8' are secured to a plate 9. A rod 10 is screwed to a hole defined in the plate 9. The upper end of the rod 10 has a handle 11, and the lower end of the rod 10 has a disk 12.

A plate 13 is arranged on the roller 7. The lower surface of the plate 13 has a curved portion, which corresponds to the curvature of the roller 7 and contacts the surface of the roller 7. The rod 8 passes through a hole defined in the plate 13. A coil spring 14 is arranged between the lower surface of the disk 12 and upper surface of the plate 13. Therefore, the pressure of roller 7 against the roller 6 can be adjusted by rotating the handle 11 so as to compress the coil spring 14 against the roller 7. The feed roller device 3 has substantially the same design as that of the feed roller device 2. Therefore, by rotating a handle 15 the pressure of a roller 16 against a roller 17 can be adjusted. A sprocket wheel 18 and a gear 19 are secured to one end of the roller 17. The gear 19 meshes with a gear 20 which is mounted on the frame 1. The gear 20 meshes with a gear 21 which is secured to one end of the roller 6. The sprocket wheel 18 is connected by a chain 22 to a sprocket wheel 24 which is secured to an output shaft of an electric motor 23. Therefore, when the motor 23 is in operation, the rollers 17 and 6 rotate.

The heat treating station B has a frame 25 which is constructed by welding angle members. An oven 26 which extends longitudinally is fixed on the upper surface of the frame 25. A drum 27 and guiding roller 29 which extend transversely are rotatably mounted on the front portion of the frame 25. A drum 28 and a guiding roller 30 which extend transversely are rotatably mounted on the rear portion of the frame 25. A guiding roller 31 which extends transversely is rotatably mounted on the front portion of the frame 25. A guiding roller 32 which extends transversely is rotatably mounted on the rear portion of the frame 25. A tension regulating device 33 is arranged on the rear portion of the frame 25. The tension regulating device 33 has a plate 34 which is secured to the frame 25 and which has a guiding groove 35. A bracket 36 is secured to the sliding plate 36' which slide in the guiding groove 35. One end of a threaded rod 37 is rotatably attached to the bracket 36, and another end of the rod 37 is screwed to a nut 38 which is secured to the plate 34 by bolts. A tension regulating roller 39 which extends transversely is rotatably mounted to the bracket 36.

An endless conveyor lattice 40 encloses the drum 27, the guiding rollers 29 and 30, the drum 28, the tension regulating roller 39, and guiding rollers 31 and 32. When the rod 37 is rotated, the roller 39 horizontally displaces so as to regulate the tension of the conveyor lattice 40. It is necessary that the width of the conveyor lattice 40 be larger than the width of fiber assembly to be treated. Preferably the conveyor lattice 40 is made of materials which have good reflection ability against for infrared ray, for example, aluminum wire.

A sprocket wheel 41 is secured to one end of the drum 27. Through a chain 42 the sprocket wheel 41 is connected to a sprocket wheel 45 which is secured to an output shaft of an electric motor 43 which can vary its speed of rotation. Therefore, when the motor 43 rotates, the conveyor lattice 40 moves. The motor 43 is protected by a cover plate 46 which is secured to the frame 25.

A guiding plate 93 is arranged between the roller 17 and the drum 27. One end of the plate 93 is connected to the feed roller device 3 and the other end of the plate 93 is secured to the frame 25. A roller 94 which freely rotates on the conveyor lattice 40 is mounted on the frame 25 adjacent to the end of the guiding plate 93. A brush 100 for cleaning the conveyor lattice 40 is secured to the frame 25. A blower 47 is secured to the frame 25 by a angle member 101. The blower 47 includes a duct 48 and a fan 49 mounted therein and the outlet of the duct 48 faces the lower surface of the lattice conveyor 40 as shown in FIG. 2-*a*. When the fan 49 rotates, cooling air is blown against the conveyor lattice 40 so as to cool it.

The oven 26 comprises a front wall 50, rear wall 52, top wall 54, bottom wall 55, and side walls 56 and 57. Guiding rollers 58 and 59 which extend transversely are rotatably mounted on the side walls 56 and 57. The upper part of the conveyor lattice 40 is introduced into a chamber 102 which is defined by the walls 50, 52, 54, 55, 56 and 57, through an inlet slot 51 which is defined in the wall 50. The conveyor lattice 40 is guided on the guiding rollers 58 and 59 in the chamber 102. The conveyor lattice 40 exits from the chamber 102 through an outlet slot 53 defined in the rear wall 52.

A plate 60 adopted for attaching infrared ray heaters is arranged on the inner surface of the top wall 54. One end of each of a plurality of threaded rods 61 is rotatably mounted to the plate 60, the intermediate portions of the rods 61 are screwed into respective threaded holes defined in the top wall 54, and the other ends of the rods 61 are secured to respective handles 62. When the handles 62 are rotated, the plate 60 displaces upwardly or downwardly. A series of infrared ray heaters 63 each of which extend transversely and is parallel to the adjacent heaters, are attached to the lower surface of the plate 60 by suports 108 at the ends of lamps 63. Another plate 64 adopted for attaching infrared ray heaters is arranged on the inner surface of the bottom wall 55. The plate 64 is mounted to the bottom wall 55 in substantially the same manner as mentioned above. Therefore, when the handles 65 are rotated, the plate 64, with plurality of infrared ray heaters 66 attached to the upper surface thereof is displaced upwardly and downwardly.

Elongated infrared ray heaters 67, are attached to the inner surfaces of the side walls 56 and 57 by supports 109 along the longitudinal direction thereof.

An ejector 68 for compressed air is arranged above the conveyor lattice 40 in the inlet slot 51. Another ejector for compressed air 68′ is arranged below the conveyor lattice 40 in the inlet slot 51. The ejectors 68 and 68′ are secured to the outer face of the front wall 50 by angle members 69 and 69′ respectively.

Figure 5:
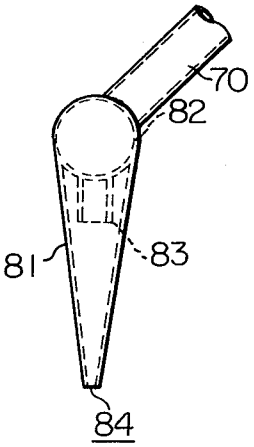
FIG. 5 is a side view of the air ejector shown in FIG. 3.
Figure 3:
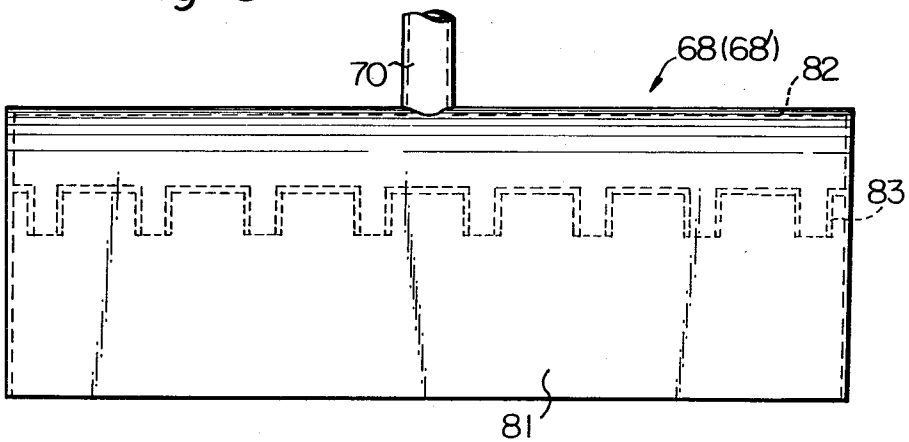
FIG. 3 is an enlarged plan view of an air ejector for forming an air curtain employed in the apparatus shown in FIG. 1.
Figure 4:
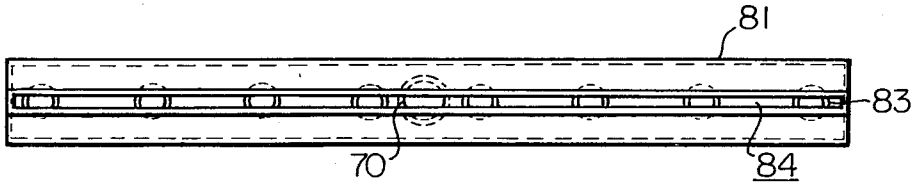
FIG. 4 is an elevational view of the air ejector shown in FIG. 3.

Referring to FIGS. 3, 4 and 5, the ejector 68 (or 68′) has a body 81 defining a chamber therein. A tube portion 82 the ends of which are closed is provided in the body 81.

A pipe 70 which communicates with a compressor (not shown) is connected to the tube portion 82.

A series of nozzles 83 spaced with equal interval therebetween are formed integrally with said tube portion 82. A slit 84 which extends transversely is defined in the front side of the body 81. The distance between the ends of the series of nozzles 83 and the slit 84 is so determined that air is ejected uniformly from the slit 84 along the entire length thereof.

Referring to FIGS. 1, 2-*a* and 2-*b*, the ejectors 68 and 68′ are so arranged that the compressed air ejected from the respective slits 84 (FIG. 4) form a pair of air curtains, one curtain moving between the conveyor lattice 40 and the series of heaters 63 and the other curtain moving between conveyor lattice 40 and the series of heaters 66 with each air curtain being spaced from the surface of conveyor lattice 40.

An air blowing duct 71 is arranged above the conveyor lattice 40 adjacent to the outlet slot 53. The duct 71 communicates with an air supply (not shown) and is secured to the rear end wall 52 of the oven 26 by an angle member 72. An air sucking duct 73 is arranged below the conveyor lattice 40 adjacent to the outlet slot 53. The duct 73 communicates with an air sucking device (not shown) and is secured to the rear end wall 53 by the angle member 74. The compressed airs from the ejectors 68 and 68′ pass through the chamber 102 of the oven 26 and are collected into the duct 73 with the aid of air which is blown from the duct 71 toward the duct 73.

A sprocket wheel 75, secured to one end of the drum 28 is connected to a delivery roller 77 mounted on the frame 25, through a chain 76 and a sprocket 78 which is secured to one end of the delivery roller 77. Casters 79 are mounted to the frame 25 at the bottom thereof so as to allow movement of the treating station B to a desired position.

The walls 50, 52, 54, 56 and 57 have thermal insulating materials 104 therein, for example, asbestos and glass wool, so as to thermally insulate the oven 26 from the atmosphere.

A temperature detector 85, adopted for detecting the surface temperature of infrared ray heaters and connected to a regulator (not shown) for controlling the surface temperatures of the heaters, is arranged between two of the heaters 66. In the center of the chamber 102 of the oven 26, a temperature detector 86 adopted for detecting the temperature in the chamber 102 is arranged 1 cm above the conveyor lattice 40. This detector 86 is connected to an oven temperature indicating device (not shown) which is provided in a control box of the apparatus (not shown).

Figure 6:
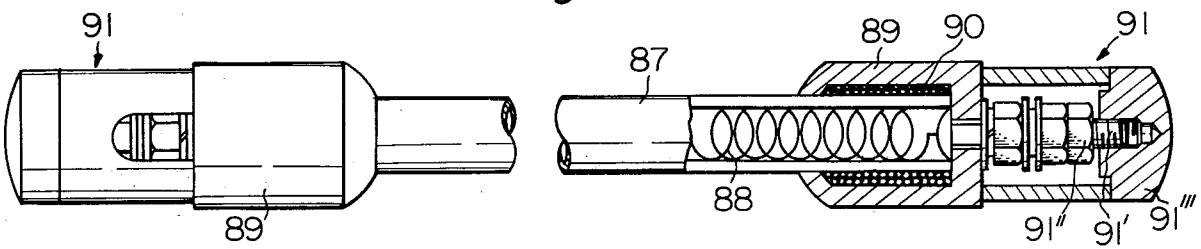
FIG. 6 is a fragmentary sectional view illustrating one form of infrared ray heaters which may be used in the practice of the invention.

Referring to FIG. 6, there is shown an example of the infrared ray heater which is used in the embodiment. The heater has a tube 87 which is made of ceramic material. A nichrome wire 88 in the shape of a coil is inserted in the pipe 87. Porcelain insulators 89 are connected to the ends of pipe 87 through an asbestos layers 90. The ends of the nichrome wire 88 are connected to connectors 91, each of which includes a bolt 91′, secured to the insulator 89 and connected to the respective end of the nichrome wire 88, nuts 91″, adopted for connecting the nichrome wire 88 to electric power supply (not shown), and a cap 91‴.

The apparatus for heat treatment of synthetic fiber assemblies which is described hereinabove operates as follows.

A fiber assembly F which forms a sheet and should be subjected to heat treatment is fed from feeding station A to the heat treating station B. The rotation of the motor 23 is transmitted to the feed roller device 2 and 3 and, thereby, the fiber assembly F which is gripped by the rollers, 6 and 7, and 16 and 17 is fed to the guide plate 93. The force gripping the fiber assembly F is adjusted by rotating the handles 11 and 15 so as to vary the pressure of the rollers 7 and 16 against the rollers 6 and 17, respectively. The fiber assembly F thus delivered to the guide plate 93 is fed to the conveyor lattice 40. The rotation of the motor 43 in the clockwise direction in FIG. 1 is transmitted to the conveyor lattice 40 which therefore, rotates as shown by an arrow $X_1$. Therefore, the fiber assembly F on the conveyor lattice 40 is fed to the inlet slot 51 of the oven 26. The fiber assembly F thus introduced into the chamber 102 receives the heat radiation from the infrared ray heaters 63, 66 and 67.

In other words, the upper surface of the fiber assembly F is heated by the series of infrared ray heaters 63 which are attached to the plate 60, and the lower surface of the fiber assembly F is heated by the other series of infrared ray heaters 66 which are attached to the plate 64. The lower surface of the fiber assembly F is heated through the conveyor lattice 40 and therefore, it is preferable that the distance between the series of heaters 66 and lower surface of the conveyor lattice 40 be shorter than the distance between the series of heaters 63 and upper surface to the conveyor lattice 40. As a result of this arrangement, both surfaces of the fiber assembly F receives uniform thermal radiation.

As the radiaton energy of infrared ray heaters which have an elongated shape decreases at the ends thereof, the two side portions of the fiber assembly F which forms a sheet will receive inadequate radiation from the heaters 63 and 66. To avoid this inadequate heating, said side portion of the fiber asssembly F is auxiliary heated by the heaters 67 which are attached to the side walls 56 and 57 of the oven 26. The distances between the series of heaters 63 and the upper surface of fiber assembly F and between the series of heaters 66 and the lower surface of the fiber assembly are adjusted by rotating the handles 62 and 65 so as to displace the plate 60 and 64, respectively.

In order to insulate the fiber assembly F from direct convective and conductive heating by the infrared ray heater, it is necessary to operate the compressor (not shown) which is connected to the pipes 70 of the ejectors 68 and 68'. The compressed air (as shown by arrows $X_2$) thus ejected from the slits 84 (FIG. 4) of the ejectors 68 and 68' form a pair of air curtains between the heaters 63 and 66 and the fiber assembly F. Each of the air curtains is spaced from the surfaces of the fiber assembly F and extends, parallel to the fiber assembly F, over substantially the whole width and length of the oven 26. With these air curtains it is possible to insulate the fiber assembly F from direct thermal convection and conduction. Therefore, they can effectively prevent excessive increase of the temperature within the oven 26 and, thereby, yellowing of the fiber assembly F may be avoided.

The fiber assembly F thus treated in the oven 26 is withdrawn from the outlet slot 53, and fed to the next process by the roller 77 driven by the drum 28 through the sprocket wheel 75, chain 76 and sprocket wheel 78. The compressed air exits from the oven through the outlet slot 53 and is sucked to the duct 73 as shown by arrows $X_3$. This is because flows of air are blown from the duct 71 toward the duct 73 as shown by arrows $X_4$, and because the duct 73 is connected operating sucking device (not shown). At the same time heated fiber assembly F is cooled by the flow of air (shown by the arrows $X_4$) from the duct 71. The heated conveyor lattice 40 is cooled by flows of air which are blown from the duct 48.

Figure 7:
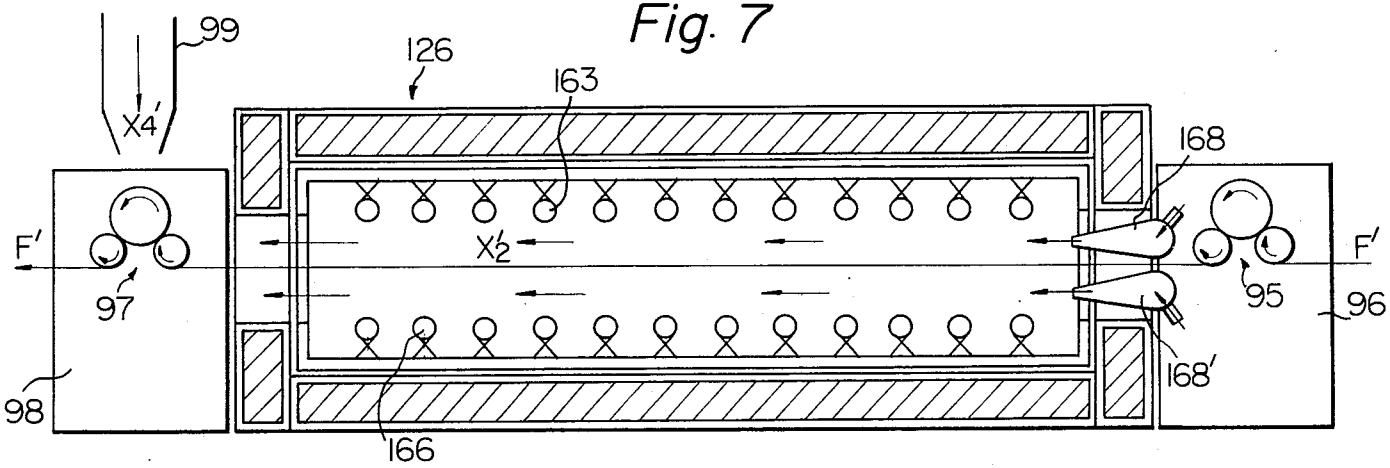
FIG. 7 is a schematic cross-sectional view illustrating another embodiment of an apparatus according to the invention.

Referring to FIG. 7, there is shown another embodiment of a heat treating apparatus according to the invention. The illustrated apparatus may be used for a thermal drawing operation for an endless synthetic fiber assembly, such as tow. The apparatus includes a longitudinally elongated oven 126. Adjacent to the inlet of the oven 126, there is provided a feeding roller stand 96 which has a feeding roller mechanism 95 formed by three rotating rollers contacting each other. A delivery roller stand 98 is arranged adjacent to the outlet side of the oven 126. The stand 98 has a delivery roller mechanism 97 which is formed by three rotating rollers contacting each other. Two series of infrared ray heaters 163 and 166 extending transversely are arranged inside the oven 126 on the top and bottom walls thereof. Endless fiber assembly F' which should be subjected to thermal treatment is gripped by feeding roller assembly 95 and delivery roller assembly 97, and is advanced through the oven 126 to expose it to the thermal radiaton effect of the heaters 163 and 166.

A pair of ejectors 168 and 168' for compressed air arranged in the inlet slot defined in the side wall of the oven 126. Each of the ejectors is so arranged that the compressed air therefrom is ejected parallel to the surface of fiber assembly F' as shown by arrows $X_2'$, so as to form a pair of air curtains between the fiber assembly F' and respective series of heaters 163 and 166. Each of said air curtains is spaced from the fiber assembly F' and extends in parallel thereto. A cooling duct 99 is arranged above the delivery roller assembly 97. Treated fiber assembly F' is cooled by flows of airs shown by arrow $X_4'$) from the duct 99.

Figure 8:
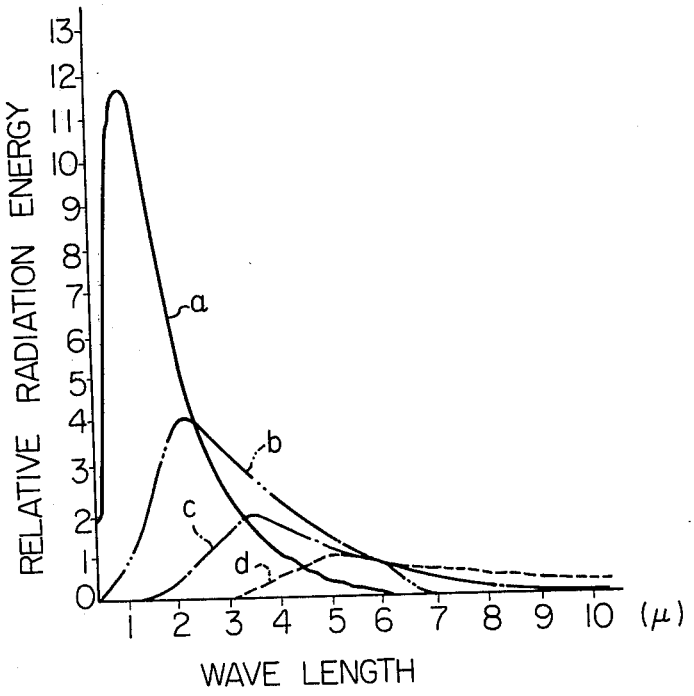
FIG. 8 is a graph showing energy distributions of various infrared rays, in which the abscissa indicates wave length in $\mu$ and the ordinate indicates relative radiation energy.

In FIG. 8, radiation energy distributions of various infrared rays are shown. The abscissa indicates a wave length in micron while the ordinate indicates a relative radiation energy. The curve designated by (*a*) represents the energy distribution of an infrared ray from heater comprising a quartz pipe and a coiled tungsten wire. With this ray, a peak of energy appears where the wave length is 1.2 $\mu$. Generally such a wave length where the radiation energy of a given ray from a given heater is the highest will be hereinafter referred to as the "peak wave length" of said ray or of said heater. The peak wave length of the infrared ray from the above-identified lamp is 1.2 $\mu$. This type of heater has been used in drying paints.

The curve designated by (*b*) in FIG. 8 represents the energy distribution of an infrared ray from a heater comprising a quartz pipe and a coiled nichrome wire. This infrared ray has a peak wave length of 2.1 $\mu$ and has heretofore been used, for examples, in contraction packaging with polyethylene film.

The curve designated by (*c*) in FIG. 8 represents the energy distribution of an infrared ray from a heater comprising a certain ceramic pipe as described in U.S. Pat. No. 3,585,390 and a coiled nichrome wire. This heater has a peak wave length of 3.5 $\mu$. A heater of this type is more specifically illustrated in FIG. 6.

The curve designated by (*d*) in FIG. 8 represents the energy distribution of an infrared ray from a heater which includes some types of semiconductor. The peak wave length of this heater is 5.5 $\mu$.

As apparent from the curves (*a*), (*b*), (*c*) and (*d*), the longer the peak wave length, the lower the total radiation energy.

Figure 9:
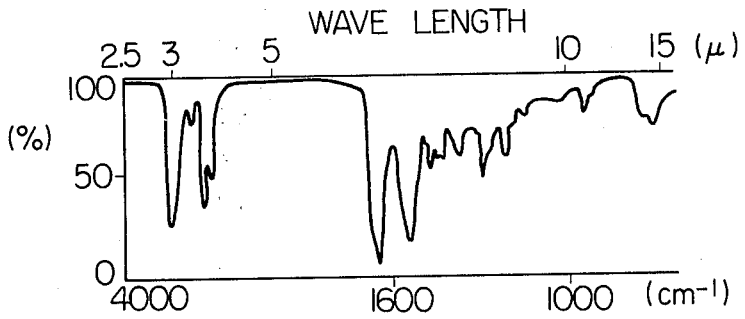
FIG. 9 through 11 are infrared charts of nylon 6 fiber, "DACRON" (polyethylene terephthalate fiber), and "ORLON" (acrylic fiber); respectively.
Figure 10:
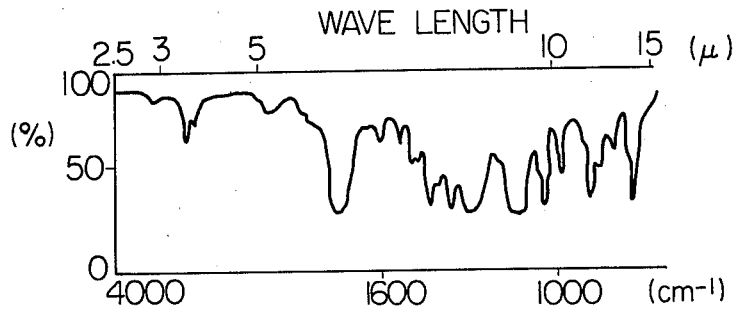
Figure 11:
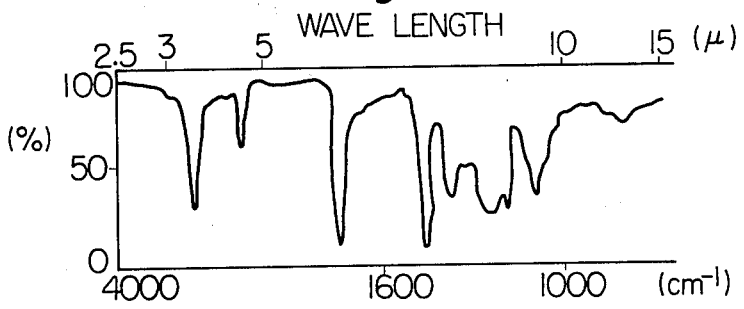

FIGS. 9, 10 and 11 are infrared charts of nylon-6, DACRON (plyethylene terephthalate) and Orlon (acrylic) fibers, respectively. It will be understood that the infrared absorption bands of the typical synthetic fibers appear at wave lengths of 3 $\mu$ and longer.

In accordance with one feature of the invention a synthetic fiber assembly is irradiated by infrared rays having such a radiation energy distribution that the peak wave length is within the range of 3.5 $\mu$ to 7.0 $\mu$. Infrared rays having shorter peak wave lengths, such as those as represented by curves (*a*) and (*b*) in FIG. 8, often cause undesirable yellowing of fiber. For example, when a fiber assembly is heat treated with an infrared ray having a peak wave length of 3 $\mu$, the surface temperature of the heaters becomes as high as about 720°C, creating an extremely hot atmosphere in the oven, on account of which it is difficult to effectively protect the fiber assembly. That is, in such a case, even if air curtains are formed in the oven, the atmosphere between the air curtains which surrounds the fiber assembly cannot be controlled below the permissible highest temperature, 280°C. With an infrared ray having a peak wave length of 3.5 $\mu$, a surface temperature of the heater of about 580°C is obtained and the atmosphere surrounding the material to be treated may readily be controlled below the higheest permissible temperature, 280°C by forming air curtains in accordance with the invention.

The far infrared ray having a peak wave length of 3.5 $\mu$, contain a substantial proportion of radiational energies of applied to snythetic fibers, are absorbed by the molecules of fibers and induce internal heat formation.

On the other hand, far infrared rays of a peak wave length of longer than 7.0 $\mu$ are excluded for practical reasons. Because of the low total radiational energy, such rays require an impractically prolonged time for the treatment of fibers.

Figure 12:
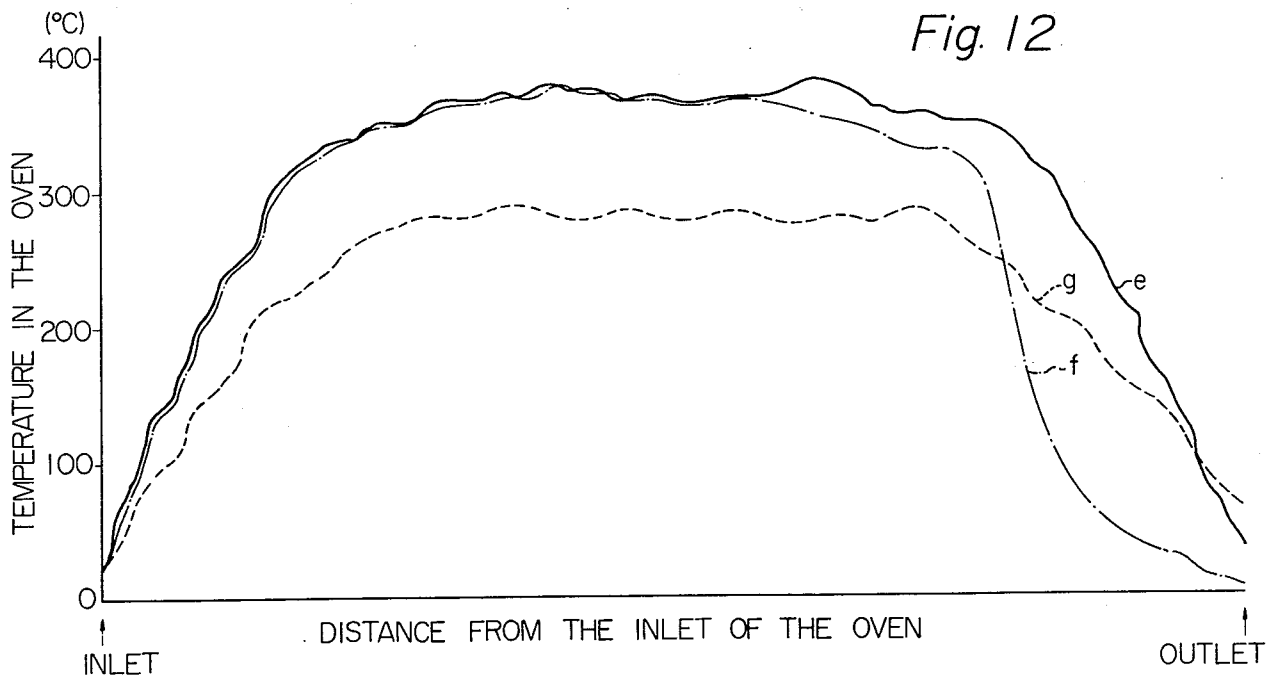
FIG. 12 is a graph showing longitudinal temperature distributions of an oven under various operating conditions.

FIG. 12 is a graph showing longitudinal temperature distribution in an oven operated under various conditions. The oven used was of a type as illustrated in FIG. 1 with a specification as hereafter described in Example 1. The temperature measurements were carried out midways of every width of the oven. Curve (*e*) in FIG. 12 represents a longitudinal temperature distribution in the oven operated without ejecting air thereinto. The conditions were identical to those in Example 1, Run 3, except that no fiber assembly was passed through the oven. Curve (*f*) in FIG. 12 represents a longitudinal temperature distribution in the oven operated while applying suction under conditions as described in Example 1, Run 4 except that no fiber assembly was treated. Curve (*g*) in FIG. 12 represents a longitudinal temperature distribution in the oven operated while forming air curtains. The conditions were the same as used in Example 1, Run 5, except that no fiber assembly was passed through the oven. As seen from curve (*e*) in FIG. 12, the temperature of the atmosphere which will surround the material to be treated is intolerably high when air is not ejected in accordance with the invention. When suction is applied, the temperature of the atmosphere in the oven will be decreased only in the proximity of the point where the suction is applied, as seen from curve (*f*) in FIG. 12. However, this is not enough to properly control the temperature over the whole length of the oven. Curve (*g*) in FIG. 12 indicates that if air curtains are properly formed in accordance with the invention the temperature of the atmosphere in the oven may be controlled properly and uniformly over a substantial length of the oven.

Figure 13:
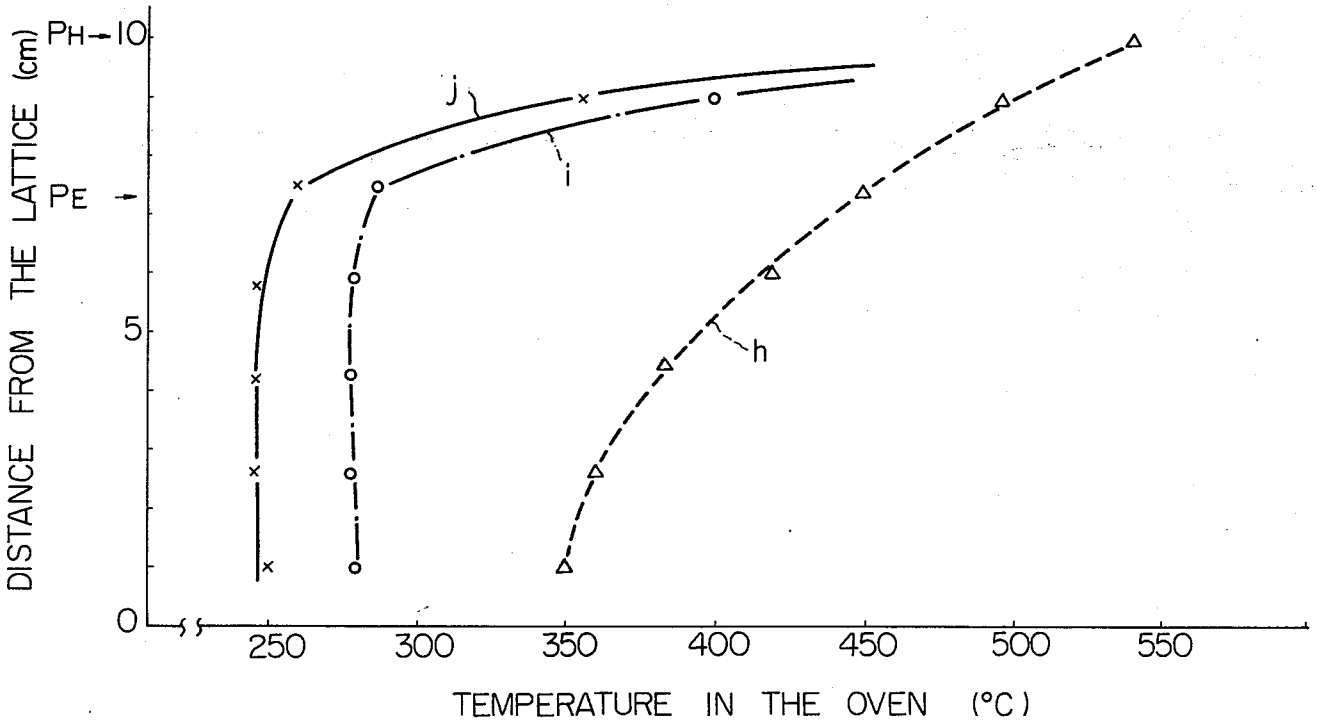
FIG. 13 is a graph showing vertical temperature distribution of an oven operated with and without air curtains.

Using the same oven and under the same conditions as used in the temperature measurements for curves (*e*) and (*g*), measurements were carried out at various levels in a vertical plane intersecting the oven at a place where the distance from the inlet 51 of the oven was 70 cm. The results are plotted in the graph given in FIG. 13, in which graph the ordinate indicates a level or distance above the lattice conveyor 40 (in cm) and the abscissa indicates a temperature (in °C) of the atmosphere in the oven. Curve (*h*) in FIG. 13 represents a vertical temperature distribution in the oven operated without air curtains and curve (*i*) in FIG. 13 represents a vertical temperature distribution in the oven operated with air curtains formed by ejecting air at a pressure of 2 Kg/cm$^2$G. In FIG. 13 is further shown a curve (*j*) representing a vertical temperature distribution in the oven using air at a pressure of 3 Kg/cm$^2$G with other conditions being the same as in the temperature measurements for curve ( *i*). Arrows designated by $P_E$ and $P_H$ indicate levels of ejector 68 and infrared heaters disposed on the top wall of the oven, respectively. It will be understood from FIG. 13 that when air curtains are formed in the oven in accordance with the invention, the temperature of the atmosphere in the oven which will surround the material to be treated can be properly controlled and can be kept substantially constant in that area in the oven interposed between the formed air curtains. This means that the air curtains formed in accordance with the invention may effectively prevent an unduly hot atmosphere adjacent to the infrared ray heaters from reaching and adversely affecting the material to be treated. FIG. 13 further indicates that the temperature of the atmosphere in the oven which will surround the material depends, at least partly, on the pressure of air ejected.

While the pressure of the atmosphere in the oven may conveniently be of an ambient pressure, the pressure of the compressed air to be ejected into the oven to form air curtains should preferably be at least 1 Kg/cm$^2$G, and more preferably from 1 to 7 Kg/cm$^2$G, in most cases.

In the practice of the process of the invention, the temperature of the atmosphere in the oven which directly contacts the fiber assembly must be adjusted to be within the range of 80° to 280°C. A particular temperature to be selected will depend on the nature of the materials (e.g. nylon tow, web of polyester stable or acrylic sliver) and the purpose of treatment (e.g. thermal drawing, heat setting under tension, thermal relaxation or drying). The adjustment or control of the temperature may be done readily by varying such factors as the peak wave length, pressure and temperature of the compressed air to be ejected, and the clearance of the slit 84 through which the air is ejected (i.e. rate of flow of the air).

The invention will be further described by the following unlimited Examples.

Example 1

Using an apparatus as shown in FIG. 1, thermal relaxation of slivers were carried out under various conditions.

The slivers used were prepared from a tow of acrylic fibers having a total thickness of 500,000 denier and a single filament thickness of 3 denier by drawing it on a multi-step Perlok-stapler with a plate temperature of 120°C and a draw ratio of 1.28 and, immediately after the drawing, stretch breaking drawn tow to shrinkable slivers.

In each of the runs 1 through 6, the sliver was fed to a feeding station A of the apparatus, where it was made into fleece-like form having a width of 20 cm and a weight of 25 g/m, and then passed to heat treating station B of the same apparatus.

Oven 26 of the apparatus had an effective length of 1.5 m and an effective width of 50 cm, and was provided with a total of 54 infrared ray heaters on its top and bottom walls, the power consumption of each heater being 50 V × 200W. Two kinds of the heaters having different peak wave lengths as indicated in Table I were respectively used. The distance of the upper series of heaters and the lattice conveyor 40, which transported the sliver to be treated, was 10 cm and the distance of the lower series of heaters and the lattice conveyor 40 was 6 cm. The dimensions of the slit 84 of the ejectors 68 (68') was 4 mm in thickness and 45 cm in width. Centers of the slit of the ejectors 68 and 68' in FIG. 1 were mounted at such levels that the slit 84 of ejector 68 is at a level 28 mm below that of the surface of the upper series of heaters and the slit of ejectors 68' is at a level 30 mm above that of the surface of the lower series of heaters. When air curtains are to be formed, air was ejected at a pressure of 2 Kg/cm²G. Other operating conditions employed are indicated in Table 1.

Results are shown in Table 1.

Table 1

| Run No. | Operating Conditions: *1 Filter | Air | Peak wave-length (μ) | *2 Tempera-ture (°C) | Time of treat-ment (sec) | Results: *3 Residual shrink-age (%) | Appearance |
|---|---|---|---|---|---|---|---|
| 1 | yes | *4 yes | 1.5 | 120 | 45 | 1.9 | good |
| 2 | yes | No | 1.5 | 560 | 9 | *5 — | Deeply yellowed; Adhesion of fibers |
| 3 | No | No | 3.7 | 350 | 5 | *6 0 - 23.0 | Yellowed |
| 4 | No | *7 Suction | 3.7 | 350 | 5 | *6 0 - 22.0 | Yellowed |
| *8 5 | No | Yes | 3.7 | 220 | 9 | 1.7 | good |
| 6 | No | *9 Yes | 3.7 | 300 | 9 | *6 1.4–10.5 | Upper side yellowed |
| 7 | No | *10 Yes | 3.7 | 260 | 9 | *6 1.8–3.7 | good |
| 8 | | Steam setting | | *11 | | 1.5 | good |

Note:

*1 A solid filter KRS No. 5 comprising a mixture of thallium bromide and thallium iodide.

*2 Detected by detector 86 as shown in FIG. 2-b.

*3 Calculated from the equation:

$$S_1 = \frac{L - L'}{L} \times 100$$

wherein $S_1$ is the percentage of residual shrinkage, L is the length of a single fiber picked out from the heat treated sliver, and L' is the length of said fiber after it has been boiled off for 30 minutes.

*4 200 cc/sec of cold air at a temperature of 14°C and a pressure of 2 Kg/cm²G was directed to the filter for the purpose of cooling.

*5 Since fibers had adhered, the measurement could not be carried out.

*6 Uneven shrinkage, indicating an uneven treatment.

*7 Instead of ejecting air, the atmosphere in the oven was drawn through an opening of 18 cm² provided adjacently to the outlet of the oven, with a rate of flow of 3000 cc/sec.

*8 Run in accordance with the invention.

*9 Air was ejected through only ejector 68'; The upper ejector 68 was not operated.

*10 Air was ejected through only ejector 68; The lower ejector 68' was not operated.

*11 The sliver was set with steam in a conventional manner with an oven temperature of 110°C and a total time treatment of 1920 sec.

In Runs 1 and 2, the infrared ray used had a peak wave length of 1.5 μ and the hot atmosphere surrounding the infrared ray heaters was prevented by a filter from reaching the sliver to be treated. When the filter was properly cooled (Run 1), satisfactory results were obtained except for the fact that a relatively long time of treatment was required. When the filter was not cooled (Run 2), the sliver was deeply yellowed and hardened due to adhesion of fibers.

In Runs 3 to 6, the sliver was exposed to an infrared ray having a peak wave length of 3.7 μ without using a filter. When air for forming the air curtains was not released (Run 3), the temperature of the atmosphere surrounding the sliver in the oven was intolerably high as seen from FIG. 12, curve (*e*), and, as a result, the surface of the sliver was yellowed and excessively contracted to become dense, which prevented the infrared radiation from transmitting into the inner parts of the sliver, thus resulting in an uneven treatment. When suction was applied (Run 4) the temperature of the atmosphere was decreased only in the proximity of the point where the suction was applied, as seen from curve (*f*) in FIG. 12. However, in the center of theoven, the temperature of the atmosphere surrounding the sliver was as high as in Run 3 and, thus, the treatment results were similar to those obtained in Run 3. Run 5 is the working example of the process of the invention.

In Run 5, air at a temperature of 20°C at a pressure of 2 Kg/cm²G was ejected by ejectors 68 and 68', with a total rate of about 10,000 cc/sec. By doing so the temperature of the atmosphere surrounding the sliver could be controlled and, the sliver could be heated under these conditions within a treatment time as short as 9 sec, with good product qualities, well comparable with those obtainable by using a steamsetter. In Run 6, air was ejected through only ejector 68', with the upper ejector 68 not being used. The sliver had been yellowed on the upper side thereof. In Run 7, only ejector 68 was utilized to eject air and ejector 68' was not operated.

While the appearance of the treated sliver was good without any yellowing of fiber on both sides, undersirable uneven shrinkage indicating uneven treating was observed.

Table 1 further included Run 8, in which the same slivermaterial was heat treated with steam using a known steamsetter. While satisfactory results were obtained with respect to product qualities, Run 8 required a total treatment time as long as 1920 sec.

Example 2

Using an apparatus as shown in FIG. 1 with a specification as described in Example 1, drying of a tow was carried out under various condtions.

The used tow was a wet, crimped acrylic tow from a plant for developing crimps with steam, containing 45% by weight of water and having a total device thickness of 500,000 denier and a single filament thickness of 3 denier. The width of the tow was 30 cm.

In each run the tow was passed through the infrared heating oven 26 while ejecting compressed air at a pressure of 5 Kg/cm² G through ejectors 68 and 68' into the oven to form protecting air curtains. Other operating conditions employed are indicated in Table II together with the results obtained.

Table II

| Run No. | Operating conditions: Peak wave length (μ) | Temperature (°C) | Time of treatment (min.) | Results: Moisture content after treatment (% owf) | State of treatment |
|---|---|---|---|---|---|
| 9 | 3.0 | 300 | 5 | 0.2 | Yellowed, partly undried |
| 10 | 3.5 | 260 | 7 | 0.2 | good |
| 11 | 4.0 | 160 | 10 | 0.5 | good |
| 12 | 5.0 | 120 | 13 | 0.9 | good |
| 13 | 6.8 | 80 | 18 | 1.5 | good |
| 14 | 8.3 | 60 | 25 | 7.5 | partly undried |

For comparison purposes the same sample of tow was dried by means of a conventional hot air drier. To reduce the water content of the tow to a level of 1.5% owf, 60 minutes treatment was required with a drying temperature of 80°C. When compared with this result, if the process and apparatus used in this example were employed to dry the same tow to the same extent, the required time may be reduced to 1/9 (with a drying temperature of 260°C) or to ¼ (with a drying temperature of 80°C).

Furthermore, when the tow was dried at a temperature of 260°C for a period of 10 minutes in the known air-drier, the outer surfaces of the tow deeply yellowed.

EXAMPLE 3

Using an apparatus as shown in FIG. 1 with a specification as described in Example 1, thermal relaxation was carried out under various conditions.

Using a turbo-stapler, a tow of acrylic fibers having a total thickness of 500,000 denier and a single filament thickness of 3 denier was drawn with a plate, temperature of 140°C and a draw ratio of 1.39 and stretch-broken to provide shrinkable slivers.

In each run the slivers so prepared was fed to feeding station A of the apparatus, where these were made into a fleecelike form having a width of 20 cm, and then passed through infrared heating oven 26 while ejecting compressed air at a pressure of 3 Kg/cm² G to form protecting air curtains. Other conditions employed are indicated in Table III together with the results obtained.

Table III

| Run No. | Operating Conditions: Peak wave length (μ) | Temp. (°C) | Time of treatment (sec.) | % contraction of sliver *1 | Residual shrinkage | Results: Whiteness | Number of slubs and neps when process on gill box (number/100g) |
|---|---|---|---|---|---|---|---|
| 15 | 3.0 | 390 | 9 | 35.1 | 0.8–1.3 | yellowed | impossible to operate gill box |
| 16 | 3.5 | 280 | 9 | 27.2 | 1.3 | good | 4 |
| 17 | 4.0 | 220 | 9 | 26.1 | 1.2 | good | 0 |
| 18 | 4.5 | 160 | 9 | 25.1 | 1.7 | good | 0 |
| 19 | 5.0 | 140 | 9 | 24.7 | 1.9 | good | 0 |
| 20 | 4.5 | 160 | 9 | 25.5 | 1.2 | good | 0 |
| 21 | 5.5 | 120 | 9 | 24.5 | 1.9 | good | 0 |
| 22 | 6.0 | 100 | 9 | 22.1 | 6.3 | good | 0 |

Note
*1 Calculated from the equation:

$$C = \frac{A - B}{A} \times 100$$

Wherein C is % of contraction of sliver, A is length of the sliver before treatment and B is length of the sliver after treatment.

For the purpose of comparison, the same sample of sliver was thermally relaxed by means of a known vacuum steam setter at a temperature of treatment of 110°C, with a total treatment time of 32 minutes containing 10 minutes of setting. By the treatment, the sliver contracted 25.5% on average. The treated sliver had a residual shrinkage of 1.5%. When the treated sliver combed using a conventional gill box, formation of 13 slubs and/or neps per 100 g of sliver was observed.

It should be noted that when the process and apparatus of the invention are used the required treatment time is drastically short when compared with that involved when the known steam setter is used. Furthermore, the slivers treated in accordance with the invention are of better quality, i.e. more readily processable, as revealed from the above-mentioned results of the gill box test.

EXAMPLE 4

Using a multi step Perlok stapler, a tow of polyester fibers was drawn with a plate temperature of 100°C and a draw ratio of 1.28 and stretch broken to provide a shrinkable sliver.

Using the same apparatus as in the preceding Examples and following the general procedure as described in Example 3, the sliver was thermally relaxed. The infrared ray heaters employed had a peak wave length of 5.5 $\mu$ and, the atmosphere surrounding the sliver in the oven was kept at a temperature of 160°C. The sliver contracted 14.1% with a time of treatment of 12 sec. The treated sliver was white enough and had a residual shrinkage of 1.5%. With a known steam setter, the same sample of sliver required 32 minutes total treatment with a treatment temperature of 110°C to contract 13.8%. The latter treated sliver had a residual shrinkage of 1.8%.

EXAMPLE 5

Mixed spun yarns made from shrinkable and non-shrinkable acrylic fibers were fed zig-zag onto conveyor lattice 40 of the apparatus as used in the preceding Examples, and then thermally relaxed by passing them through the oven 26 to provide bulky yarns. The infrared ray heaters employed had a peak wave length of 4.2 $\mu$ and the atmosphere surrounding the yarn in the oven was kept at a temperature of 200°C. The residence time of the yarn in the oven was 4 sec. The specific volume of the product was 14.2 $cm^3/g$, as measured by means of a compression elasticity tester. Whereas a product obtained by steaming the same sample of mixed yarns in a conventional manner had a specific volume of 13 $cm^3/g$. Further, the product obtained according to the invention had softer feel.

EXAMPLE 6

Using an apparatus of a type as illustrated in FIG. 7, the acrylic tow as described in Example 3 was drawn. The temperature of the atmosphere which surrounds the tow in the oven 126 was 220°C, the peripheral speed of the delivery roller 97 was 30 m/min, and the residence time of the tow in the oven was 5 sec. The single filament shrinkage, in boiling water of the drawn tow was 25.2% on average with a longitudinal variation of 2% and a lateral variation of 3%. Whereas, when another portion of the same tow was drawn with a hot plate at a temperature of 220°C to the same extent, the drawn tow exhibited % of shrinkage of 25.1% on average with a longitudinal variation of 3% and a lateral variation of 8%. The "variation" referred to herein is a difference between the highest % of shrinkage and the lowest % of shrinkage. Using the same apparatus and conditions, another portion of the polyester tow as used in Example 4 was thermally drawn. The drawn product was uniform and substantially free from any necked portions and any variation in the physical properties of the fibers.

It should be appreciated that using the process and apparatus of the invention various heat treatments of synthetic fibers, including thermal drying, thermal drawing, thermal fixation or heat setting, and thermal relaxation, may be carried out in an industrial scale, rapidly and without suffering from any adverse effects on product qualities.

In the practice of the invention, it is not necessary to use a closed device, as is the case with the known steam setter, and the process is continuous. Accordingly, when the invention is utilized in the existing fiber-making and/or subsequent processes, various beneficial effects can be obtained, including, for example, reduction in treatment time, reduction in number of steps and saving of energy.

Furthermore, the slivers thermally relaxed in accordance with the invention are superior to those treated with steam in a conventional manner in the fact that the former products are completely free from mutual adhesion of fibers. Accordingly, the products obtainable in accordance with the invention are more readily processable in the possible subsequent processing steps than the prior art products.

What is claimed is:

1. A process for heat treatment of synthetic fiber assemblies which comprises the steps of: continuously feeding a synthetic fiber assembly to one end of a horizontally elongated treating zone provided with series of far infrared ray radiation sources at the top and bottom thereof; continuously advancing said fiber assembly through said zone; irradiating said fiber assembly with far infrared rays from said series of sources, said far infrared rays having such an energy distribution that the peak wave length is within the range between 3.5 $\mu$ and 7.0 $\mu$; forming an air curtain between said fiber assembly and each of said series of far infrared ray radiation sources by ejecting compressed air from said end of said zone into said zone, each air curtain being spaced from said fiber assembly and extending in parallel to said fiber assembly over substantially the whole width and length of said zone; keeping an atmosphere between said air curtains in said zone which directly contacts said fiber assembly at a temperature within the range between 80°C and 280°C; and continuously withdrawing said fiber assembly from the other end of said elongated treating zone.

2. A process for heat treatment of synthetic fiber assemblies in accordance with claim 1, wherein said treating zone is further provided with auxiliary infrared ray radiation sources on both sides thereof and the fiber assembly passing through said zone is further irradiated with far infrared rays from said auxiliary sources having such an energy distribution that the peak wave length is within the range between 3.5$\mu$ and 7.0 $\mu$.

3. A process for heat treatment of synthetic fiber assemblies in accordance with claim 1, wherein compressed air at a pressure of at least 1 $kg/cm^2$ G is ejected into said zone to form said air curtains.

4. An apparatus for heat treatment of synthetic fiber assemblies, which comprises: a horizontally elongated oven having an inlet at one end and an outlet at the other end; means by which a synthetic fiber assembly is fed to, advanced through and withdrawn from said oven; two series of elongated infrared ray heaters extending transversely in parallel and arranged inside said oven on the top and bottom walls thereof, each of said infrared ray heaters being capable of generating a far infrared ray having such an energy distribution that the peak wave length is within the range between 3.5 $\mu$ and 7.0 $\mu$, and a pair of means provided adjacent to said inlet for ejecting compressed air into said oven to form a pair of air curtains between each fiber assembly and its respective series of heaters, each of said air curtains being spaced from said fiber assembly and extending in parallel to said fiber assembly over substantially the whole width and length of said oven.

5. An apparatus for heat treatment of synthetic fiber assemblies according to claim 4, wherein said means by which the synthetic fiber assembly is fed to, advanced through and withdrawn from said oven comprises: a pair of drums which transversely extend and are rotatably mounted to a frame of said oven; an endless conveyor lattice looping around said drums through said inlet and said outlet; and means for driving one of said drums.

6. An apparatus for heat treatment of synthetic fiber assemblies according to claim 4, wherein said means by which the synthetic fiber assembly is fed to, advanced through and withdrawn from said oven comprises: a feed roller stand arranged in front of said inlet; and a delivery roller stand arranged at the rear of said outlet.

7. An apparatus for heat treatment of synthetic fiber assemblies according to claim 4, wherein one of said two series of infrared ray heaters is mounted vertically displaceable to said top wall, and the other is mounted vertically displaceable to said bottom wall.

8. An apparatus for heat treatment of synthetic fiber assemblies according to claim 5, wherein a duct connected to an air supply is provided outside of said oven adjacent to said outlet, said duct facing to one side of said conveyor lattice, and another duct connected to a sucking device is provided outside of said oven adjacent to said outlet, said other duct facing the other side of said conveyor lattice.

9. An apparatus for heat treatment of synthetic fiber assemblies according to claim 6, wherein a duct connected to a supply for cooling the treated fiber assembly is provided outside of said oven adjacent to said outlet, said duct facing delivery rollers of the delivery roller stand.

10. An apparatus for heat treatment of synthetic fiber assemblies according to claim 7, wherein each of said means for ejecting compressed air into said oven comprises a body having a chamber, series of nozzles communicating therewith, and an elongated slit facing said series of nozzles, said body being connected to a supply of the compressed air, the distance between said nozzles and said slit being such that compressed air from said supply is ejected uniformly from said slit along the whole length thereof.

11. An apparatus for heat treatment of synthetic fiber assemblies according to claim 4, wherein auxiliary elongated infrared ray heaters extending longitudinally are provided inside said oven on the side walls thereof.

* * * * *